US006181057B1

(12) United States Patent
Inoue et al.

(10) Patent No.: US 6,181,057 B1
(45) Date of Patent: Jan. 30, 2001

(54) ELECTRODE ASSEMBLY, CATHODE DEVICE AND PLATING APPARATUS INCLUDING AN INSULATING MEMBER COVERING AN INTERNAL CIRCUMFERENTIAL EDGE OF A CATHODE MEMBER

(75) Inventors: Satoshi Inoue, Kitasaku-gun; Toyoaki Tanaka, Saku, both of (JP)

(73) Assignee: TDK Corporation, Tokyo (JP)

( * ) Notice: Under 35 U.S.C. 154(b), the term of this patent shall be extended for 0 days.

(21) Appl. No.: 09/152,789

(22) Filed: Sep. 14, 1998

(30) Foreign Application Priority Data

Sep. 18, 1997 (JP) ..... 9-253993

(51) Int. Cl.[7] ..... H01J 1/20

(52) U.S. Cl. ..... 313/338; 313/446; 313/449; 204/280

(58) Field of Search ..... 313/446, 338, 313/340, 337, 250, 287, 265, 268, 444, 449; 204/280, 286, 288.1, 297.01, 224 R

(56) References Cited

U.S. PATENT DOCUMENTS 3,805,106 * 4/1974 Hooker ..... 313/338
5,700,381 12/1997 Kimura et al. ..... 216/22
5,828,163 * 10/1998 Jones et al. ..... 313/82
5,892,322 * 4/1999 Muchi et al. ..... 313/417

FOREIGN PATENT DOCUMENTS 4-66698 3/1992 (JP) .
5-125596 5/1993 (JP) .

* cited by examiner

*Primary Examiner*—Nimeshkumar D. Patel
*Assistant Examiner*—Joseph Williams
(74) *Attorney, Agent, or Firm*—Oblon, Spivak, McClelland, Maier & Neustadt, P.C.

(57) ABSTRACT

An electrode assembly, including a cathode member is provided with a hole enclosed by a frame portion and a contact surface that comes into contact with an object to be plated at one surface of the frame portion. The cathode member include a conductive material such as copper plate. The cathode member is provided with a lead conductor. An insulating member is provided with holes and enclosed by frame portions, with the frame portions and placed on another surface of the frame portion of the cathode member. The frame portion of the first insulating member covers the internal circumferential edge of the cathode member over a width W1.

19 Claims, 5 Drawing Sheets

ELECTRODE ASSEMBLY, CATHODE DEVICE AND PLATING APPARATUS INCLUDING AN INSULATING MEMBER COVERING AN INTERNAL CIRCUMFERENTIAL EDGE OF A CATHODE MEMBER

BACKGROUND OF THE INVENTION

1. Field of the Invention

The present invention relates to an electrode assembly, a cathode device and a plating apparatus that may be employed in an ideal manner when plating substrates for various types of electronic components, IC wafers or the like.

2. Discussion of Background

During a plating process for substrates for various types of electronic components and IC wafers and the like, plating must be implemented within a limited planar area on the object that is being plated, i.e., the substrate or wafer. In order to implement a plating process, a plating base film is formed in advance on a surface of the object to be plated and then plating is implemented by placing a cathode device in surface contact with the plating base film in such a manner that the cathode device surrounds the plating area. Publications that disclose this prior art technology include Japanese Unexamined Patent Publication No. 66698/1992 and Japanese Unexamined Patent Publication No. 125596/1993. In the cathode devices of the known art disclosed in these publications, a cathode is placed in surface contact with the object being plated.

Methods that may be adopted to plate an object to be plated such as a wafer include the frame plating method and the pattern plating method. In the frame plating method, a resist frame is formed in advance on the wafer by employing a high-precision pattern forming technology such as photolithography and the required plate is electro-deposited within an area that is not covered by the resist frame.

In the pattern plating method, almost the entire surface of the plate forming surface of the object to be plated is covered with a resist film, a pattern of perforations for plating is opened in the resist film and the plate is electro-deposited at the area where the pattern of perforations is present.

Cathode devices employed in the frame plating method and the pattern plating method bear similarity in that they are provided with a cathode member that comes in contact with the plating base film deposited at a front surface of the object to be plated, although their structural characteristics are somewhat different otherwise. The cathode member is provided with a frame portion that comes in contact with the object to be plated and a hole through which the plating bath solution enters. The internal circumferential edge of the frame portion that defines the hole is exposed.

One of the problems of the cathode device in the prior art described above is caused by the exposure of the internal circumferential edge of the cathode member that comes into contact with the plating base film. When the internal circumferential edge of the cathode member is exposed, the plating film becomes deposited in a continuous manner between the plating base film and the internal circumferential edge of the cathode member. If the plating film becomes deposited in this manner, the plating film and the plating base film deposited on the object to be plated will peel off at the contact area where they are in contact with the cathode member when the object to be plated is removed from the cathode device after the plating process is completed in the frame plating method.

In the pattern plating method, the plating film will become adhered to the internal circumferential edge of the cathode member, causing a change in the diameter of the hole at the cathode member, and thus, when continuous plating is implemented using a single cathode device to plate different wafers, the film formation rate of the plating film among the individual wafers becomes unstable, which results in poor repeating reproducibility among the wafers.

SUMMARY OF THE INVENTION

It is an object of the present invention to provide an electrode assembly, a cathode device and a plating apparatus with which it is possible to prevent a plating film formed on an object to be plated from becoming peeled off when the frame plating method is employed.

It is a further object of the present invention to provide an electrode assembly, a cathode device and a plating apparatus with which the repeating reproducibility among wafers can be improved when the pattern plating method is adopted.

In order to achieve the objects described above, the electrode assembly according to the present invention includes a cathode member, and an insulating member. The cathode member is provided with a hole enclosed by a frame portion and a contact surface that comes into contact with an object to be plated at one surface of the frame portion. The insulating member is provided with a hole enclosed by a frame portion, with one surface of the frame portion lying adjacent to another surface of the frame portion of the cathode member, its hole being concentric with the hole of the cathode member and the internal circumferential edge of the frame portion covering the internal circumferential edge of the cathode member. The cathode device according to the present invention includes the electrode assembly described above.

The general structure of the plating apparatus according to the present invention includes a plating tank, a cathode device and an anode device. The cathode device and the anode device constitute an electric circuit for performing plating via a plating bath solution implemented inside the plating tank.

In the plating apparatus described above, when a DC voltage using the anode as a positive electrode and the cathode as a negative electrode is applied, required plating is implemented on a plate forming surface (conductive surface) of the object to be plated whose potential is maintained equal to the potential of the cathode member in conformance to the line of electrical force flowing from the anode to the cathode via the plating bath solution. The plate forming surface is constituted of a plating base film.

In the plating apparatus according to the present invention, the cathode device according to the present invention described earlier is employed as its cathode device. Since the cathode member is provided with a hole enclosed by a frame portion and a contact surface that comes into contact with the object to be plated at one surface of the frame portion in the cathode device according to the present invention, the plate forming surface (conductive surface) of the object to be plated can be placed in contact with the frame portion of the cathode member.

The cathode device according to the present invention further includes the insulating member which is provided with a hole enclosed by a frame portion with one surface of the frame portion lying adjacent to another surface of the frame portion of the cathode member and its hole concentric with the hole of the cathode member. Consequently, the plating bath solution can be placed in contact with the plate forming surface (conductive surface) of the object to be plated through the hole at the insulating member and the hole at the cathode member.

The present invention is characterized in that the internal circumferential edge of the frame portion of the insulating member covers the internal circumferential edge of the cathode member in the electrode assembly or the cathode device structured as described above. This structure allows the insulating member with no plate deposited to be present between the plate forming surface of the object to be plated and the internal circumferential edge of the cathode member. Thus, when the frame plating method is employed, the plating film and the plating base film that have been deposited on the object to be plated can be prevented from becoming peeled off when removing the object to be plated from the cathode device after the plating process is completed. In the prior art, since the internal circumferential edge of the cathode member is exposed, the plating film is formed continuously from the plate forming surface of the object to be plated to the internal circumferential edge of the cathode member to cause the plating film deposited on the object to be plated to become peeled off when removing the object to be plated from the cathode device after the plating process is completed.

When the pattern plating method is employed, since the insulating member onto which the plating film cannot be deposited is present between the internal circumferential edge of the cathode member and the resist frame, the plating film does not become adhered to the internal circumferential edge of the cathode member. As a result, even when a single cathode device is employed to plate different wafers continuously, the plating process can be implemented with the cathode member maintaining a constant bore diameter at all times. This stabilizes the film formation rate of the plating film among the individual wafers to achieve an improvement in the repeating reproducibility among the wafers.

In another desirable mode, a second cathode member may be provided in addition to the cathode member which is electrically continuous to the plating base film of the wafer. By providing the second cathode member, consistency can be achieved in the distribution of the line of electrical force traveling from the anode device to the cathode device at the wafer plate forming surface to realize a consistent plating film thickness distribution. An electrode assembly in this mode is suited for constituting a cathode device for frame plating.

The insulating member is provided between the second cathode member and the cathode member. This structure allows the entire electrode assembly to achieve tight contact by taking advantage of the resiliency and the like of the insulating member. By providing an appropriate degree of hardness (rigidity) in the insulating member, the insulating member can be prevented from becoming deformed while assuring the tight contact afforded by its resiliency. The second cathode member described above is not required when constituting a cathode device for pattern plating.

In a desirable mode of the two types of cathode devices described above, the insulating member includes a first insulating member and a second insulating member. The first insulating member is constituted of a resilient member and is provided with a hole enclosed by a frame portion. The second insulating member, which is constituted of a material that is harder than the first insulating member, is provided with a hole enclosed by a frame portion and is positioned adjacent to the first insulating member. In this desirable mode, sufficient tight-contact force is assured through the resiliency of the first insulating member and, at the same time, erroneous positioning, which may otherwise occur due to resilient deformation of the first insulating member, can be prevented by the presence of the second insulating member.

In the mode described above in which the insulating member includes the first insulating member and the second insulating member, the first insulating member covers the internal circumferential edge of the cathode member. This structure ensures that the resiliency of the first insulating member constituted of a resilient material is directly applied to the cathode member in a reliable manner.

Preferably, the cathode device according to the present invention should include a holder having a through hole, to support the electrode assembly that includes the cathode member, the insulating member and the second cathode member. This structure allows the electrode assembly to be mounted at the holder in advance and the holder to be mounted at the plating tank, to facilitate the process for mounting the cathode device at the plating tank.

BRIEF DESCRIPTION OF THE DRAWINGS

Other objects, structural features and advantages of the present invention are explained in further detail by referring to the attached drawings that illustrate preferred embodiments. However, it is to be noted that the attached drawings are only provided as a means for illustrating embodiments.

DETAILED DESCRIPTION OF THE PREFERRED EMBODIMENTS

Figure 1:
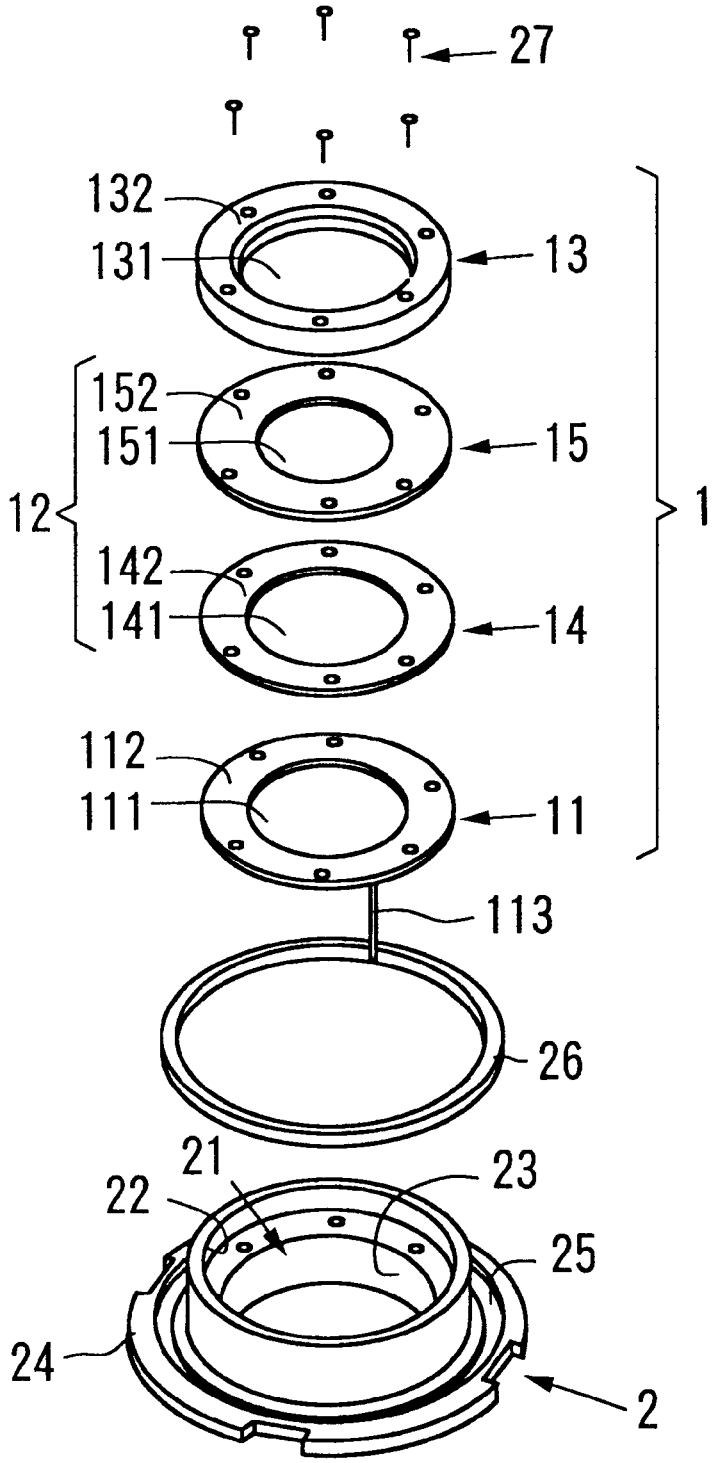
FIG. 1 is an exploded perspective of the cathode device according to the present invention
Figure 2:
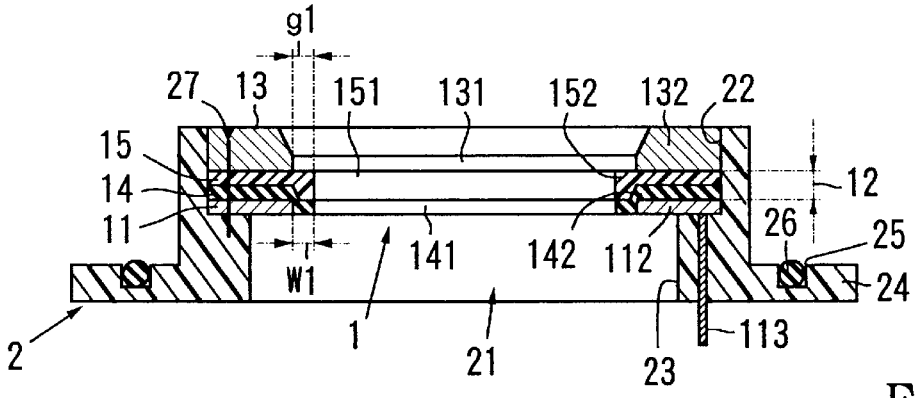
FIG. 2 is a frontal cross section of the cathode device in FIG. 1 in an assembled state.

Referring to FIGS. 1 and 2, the cathode device comprises a cathode member 11, an insulating member 12 and a second cathode member 13, which, together, constitute an electrode assembly 1. The cathode member 11 is provided with a hole 111 enclosed by a frame portion 112 and a contact surface that comes into contact with an object to be plated at one surface of the frame portion 112 (the lower surface in the figures). The cathode member 11 is constituted by using a conductive material such as a copper plate. The cathode member 11 is provided with a lead conductor 113.

The insulating member 12 is provided with holes 141 and 151 enclosed by frame portions 142 and 152. The frame portions 142 and 152 are placed over another surface of the frame portion 112 of the cathode member 11 (the upper surface in the figures). The frame portion 142 belonging to the first insulating member 14 covers the internal circumferential edge of the cathode member 11 over a width W1.

The second cathode member 13 is provided with a hole 131 enclosed by a frame portion 132 that is placed over the upper surface of the frame portion 152 of the insulating member 12. The second cathode member 13 is constituted of a conductive material such as copper.

In the embodiment, the insulating member 12 includes a first insulating member 14 and a second insulating member 15. The first insulating member 14, which is constituted of a resilient material, is provided with the hole 141 surrounded by the frame portion 142. An example of the material that is to constitute the first insulating member 14 is rubber. The first insulating member 14 covers the internal circumferential edge of the cathode member 11 with the internal circumferential edge of its frame portion 142 over the width W1.

The second insulating member 15, which is constituted of a material harder than that constituting the first insulating member 14, is provided with the hole 151 enclosed by the frame portion 152 and is placed on the first insulating member 14 coaxially. The second insulating member 15 is constituted of a non-conductive material which is harder than that constituting the first insulating member 14 and has chemical resistant properties. A desirable example is PEEK (polyether.ether.keton). Alternatively, the second insulating member 15 may be constituted of engineering plastic having outstanding chemical resistant properties such as vinylchloride. The second insulating member 15 is located above the first insulating member 14 (in the figures) so that the first insulating member 14 is present between the cathode member 11 and the second insulating member 15.

The embodiment is further provided with a holder 2. The holder 2, which is constituted of an electrically insulating material such as Teflon, polypropylene or vinylchloride, is provided with a through hole 21 constituted by opening its two ends in the axial direction. The through hole 21 includes a first hole portion 22 and a second hole portion 23 so that the electrode assembly 1 can be housed inside the first hole portion 22 and the object to be plated can be inserted in the second hole portion 23. An o-ring 26 is inserted in a circular groove 25 provided at a surface of a collar portion located at one end. A fastener 27, which may be, for instance, a screw constituted of a conductive material such as stainless steel, titanium or the like, secures the electrode assembly 1 at a staged surface of the holder 2 by tightening. Through this fastener 27, the second cathode member 13 is made electrically continuous with the first cathode member 11.

Figure 3:
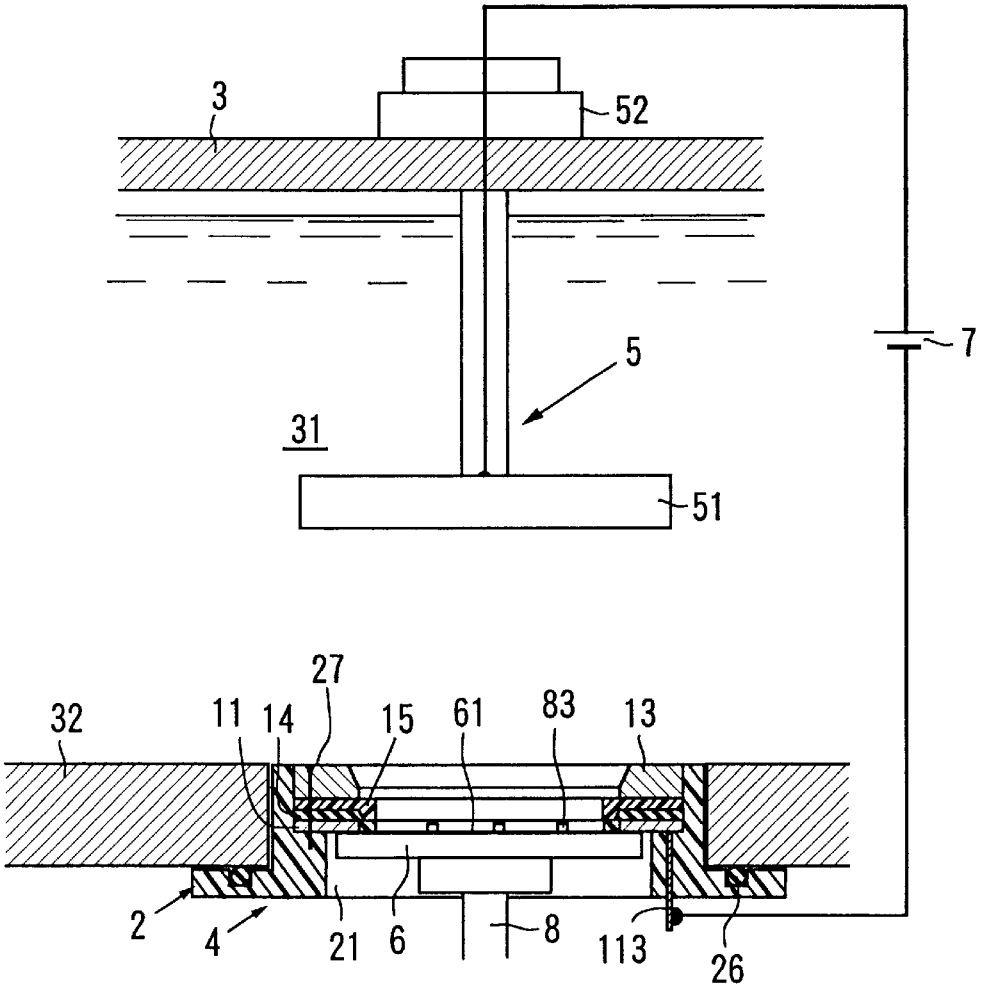
FIG. 3 illustrates the structure of the plating apparatus according to the present invention

FIG. 3 illustrates the structure of the plating apparatus according to the present invention. The plating apparatus in the figure includes a plating tank 3, a cathode device 4 and an anode device 5. Reference number 6 indicates an object to be plated, reference number 7 indicates a power supply device and reference number 8 indicates a booster device.

The plating tank 3 contains a plating bath solution 31. A bath solution composition which corresponds to the desired plating film should be selected for the plating bath solution 31.

The anode device 5 is positioned so that its anode 51 faces opposite the cathode device 4 via the plating bath solution 31. The anode 51 is supported by a supporting device 52 mounted at the plating tank 3.

The object to be plated 6, which may be, for instance, a substrate for various types of electronic components or an IC wafer, is provided with a plate forming surface 61 constituted of, for instance, a plating base film at one of its surfaces, with a resist frame 83 provided at the plate forming surface 61. The resist frame 83 is formed through a high-precision pattern forming technology such as photolithography. The plate forming surface 61 of the object to be plated 6 is placed in tight contact with the cathode member 11 by the booster device 8.

The cathode device 4 is placed in tight contact with a supporting plate 32 constituting the bottom portion of the plating tank 3 by the o-ring 26 or the like provided at the holder 2 so that the plating bath solution 31 does not leak from the inside of the plating tank 3. The power supply device 7 is connected between the cathode device 4 and the anode device 5 to apply a DC voltage between them. The cathode member 11 constituting the cathode device 4 is provided with the lead conductor 113 to which a lead wire led from the power supply device 7 is connected.

As has already been described in reference to FIGS. 1 and 2, the cathode member 11 is provided with the hole 111 enclosed by the frame portion 112 and the contact surface that comes in contact with the object to be plated 6 at the lower surface of the frame portion 112. Thus, the plate forming surface 61 of the object to be plated 6 can be placed in contact with the frame portion 112 of the cathode member 11. The object to be plated 6 is pressed by the booster device 8 so that its plate forming surface 61 achieves tight contact with the frame member 112 of the cathode member 11.

The cathode device 4 is provided with the holder 2 which, in turn, is provided with the through hole 21 and supports the electrode assembly 1 that includes the cathode member 11, the insulating member 12 and the second cathode member 13. Since this structure makes it possible to mount the electrode assembly 1 in advance at the holder 2 before mounting the holder 2 at the plating tank 3, the process for mounting the cathode device 4 at the plating tank 3 is facilitated.

Figure 4:
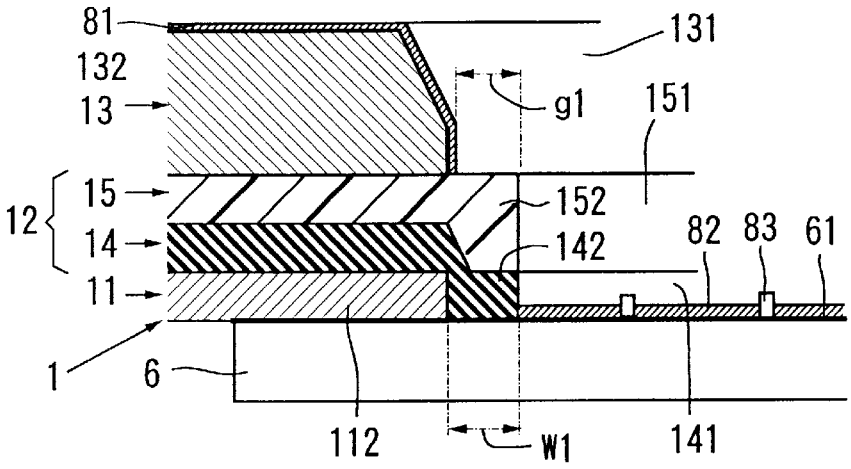
FIG. 4 illustrates deposition of a plating film achieved by employing the cathode device illustrated in FIGS. 1 and 2.

Since the insulating member 12 is provided with the holes 141 and 151 enclosed by the frame portions 142 and 152 respectively, and is placed over another surface of the cathode member 11 and the second cathode member 13 is provided with the hole 131 enclosed by the frame portion 132 and is provided adjacent to the insulating member 12, the plating bath solution 31 can be placed in contact with the plate forming surface 61 of the object to be plated 6 through the holes 141 and 151 of the insulating member 12, the hole 131 of the second cathode member 13 and the hole 111 of the cathode member 11. The plate forming surface 61 is constituted of a plating base film having a property of electrical conductivity. Thus, by applying a voltage using the anode 51 as a positive electrode and the cathode member 11 as a negative electrode, a plating film 82 can be electro-deposited on the plate forming surface 61 of the object to be plated 6 where it is not covered by the resist frame 83, as illustrated in FIG. 4. A plating film 81 is formed at a front surface of the second cathode member 13, too.

Since the insulating member 12 is provided between the second cathode member 13 and the cathode member 11, the entire electrode assembly 1 can be placed in tight contact by utilizing the resiliency and the like of the insulating member 12. In the embodiment, the insulating member 12 includes the first insulating member 14 and the second insulating member 15 so that sufficient tight-contact force is assured through the resiliency of the first insulating member 14 while preventing incorrect positioning which may otherwise occur due to the resilient deformation of the first insulating member 14 with the presence of the second insulating member 15.

Furthermore, the insulating member 12 covers the internal circumferential edge of the cathode member 11 with the internal circumferential edge of the frame portion 142 of its first insulating member 14 over the width W1, as illustrated in FIG. 4. Since this structure allows the first insulating member 14 with no plating film 82 deposited to be present between the plate forming surface 61 of the object 6 to be plated and the internal circumferential edge of the cathode member 11 over the width W1, the plating film 82 deposited on the object to be plated 6 can be prevented from becoming peeled off when removing the object 6 to be plated from the cathode device 4 after the plating process is completed.

In contrast, if the internal circumferential edge of the cathode member 11 is exposed, the plating film will be formed continuously from the plate forming surface 61 of the object to be plated 6 to the internal circumferential edge of the cathode member 11. This may cause the plating film 82 or the plating base film deposited on the object to be plated 6 to become peeled off when removing the object to be plated 6 from the cathode device 4 after the plating process is completed.

In the embodiment, the insulating member 12 includes the first insulating member 14 and the second insulating member 15. The first insulating member 14 is constituted of a resilient material whereas the second insulating member 15 is constituted of a material that is harder than that constituting the first insulating member 14 and is placed over the first insulating member 14. Through this structure, sufficient tight-contact force is assured through the resiliency of the first insulating member 14 and at the same time, incorrect positioning which may otherwise occur due to resilient deformation of the first insulating member 14 can be prevented by the second insulating member 15.

In the mode described above, in which the insulating member 12 includes the first insulating member 14 and the second insulating member 15, the internal circumferential edge of the cathode member 11 is covered by the first insulating member 14 over the width W1. This structure allows the resiliency of the first insulating member 14 constituted of a resilient material to be directly applied to the cathode member 11 in a reliable manner so that overall tight contact is assured in spite of the presence of the hard second insulating member 15.

A gap g1 is created between the internal circumferential edge of the insulating member 12 and the second cathode member 13 in the embodiment illustrated in FIGS. 1 and 2. This structure is effective for achieving consistency in the plating film thickness distribution within the plane of the plate forming surface 61 of the object to be plated 6.

Figure 5:
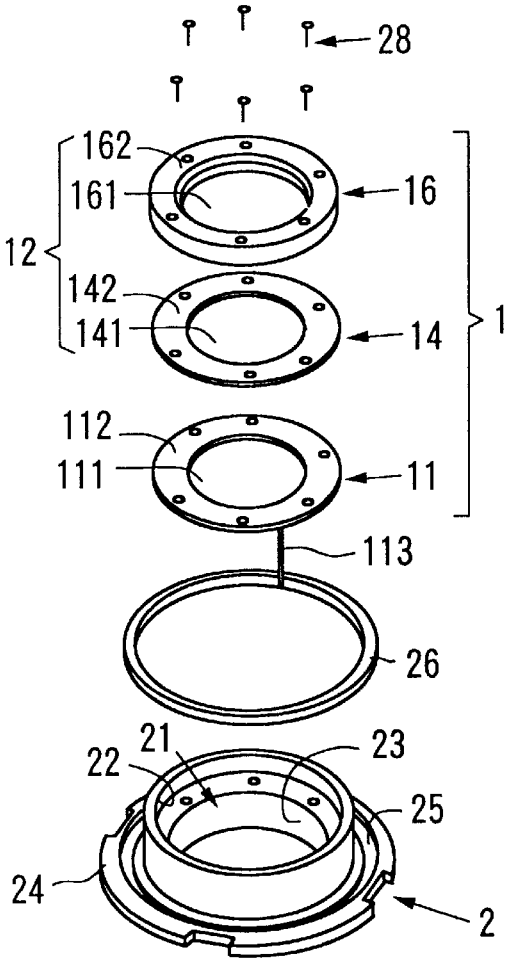
FIG. 5 is an exploded perspective illustrating another embodiment of the cathode device according to the present invention
Figure 6:
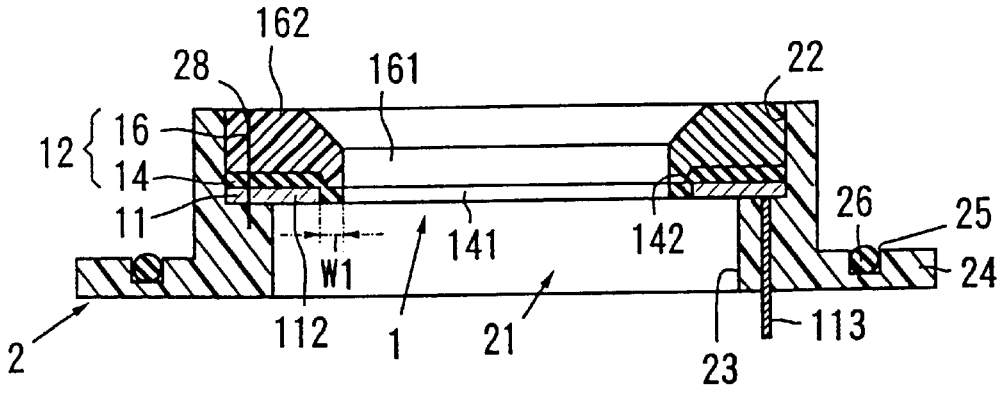
FIG. 6 is a frontal cross section of the cathode device in FIG. 5 in an assembled state

FIG. 5 is an exploded perspective illustrating another embodiment of the cathode device according to the present invention and FIG. 6 is a frontal cross section of the cathode device shown in FIG. 5 in an assembled state. The cathode device in this embodiment is suited to be employed in the pattern plating method. In the figures, the same reference numbers are assigned to components identical to those in FIGS. 1 and 2.

The cathode device in the figures includes a cathode member 11 and an insulating member 12, which together constitute an electrode assembly 1. The cathode member 11 is provided with a hole 111 enclosed by a frame portion 112 and a contact surface that comes into contact with an object to be plated at the lower surface of the frame portion 112 (in the figures). The cathode member 11 is constituted by using a conductive material such as a copper plate. A lead conductor 113 is provided at the cathode member 11. However, unlike the cathode device for frame plating illustrated in FIGS. 1 and 2, this cathode device is not provided with a second cathode member.

The insulating member 12 is provided with holes 141 and 161 enclosed by frame portions 142 and 162 respectively, with the frame portions 142 and 162 placed on the upper surface of the frame portion 112 of the cathode member 11 (in the figures). In the embodiment, the insulating member 12 includes a first insulating member 14 and a second insulating member 16. The first insulating member 14, which is constituted of a resilient material, is formed in a ring shape having the hole 141 at the center. An example of the material to constitute the first insulating member 14 is rubber. The first insulating member 14 covers the internal circumferential edge of the cathode member 11 with the internal circumferential edge of its frame portion 142 over a width W1.

The second insulating member 16, which is constituted of a material harder than that constituting the first insulating member 14, is provided with the hole 161 enclosed by a frame portion 162 and is placed on the first insulating member 14 coaxially. The second insulating member 16 is constituted of a non-conductive material which is harder than that constituting the first insulating member 14 and has chemical resistant properties. A desirable example is PEEK (polyether.ether.keton). The second insulating member 16 is located above the first insulating member 14 so that the first insulating member 14 is present between the cathode member 11 and the second insulating member 16. Thus, the cathode device in this embodiment is achieved by replacing the second cathode member 13 in the cathode device for frame plating illustrated in FIGS. 1 and 2 with the second insulating member 16. A fastener 28 may be a screw or the like constituted of a non conductive material or a conductive material and is used to secure by tightening the electrode assembly 1 to the staged surface of the holder 2.

The cathode device for pattern plating illustrated in FIGS. 5 and 6, too, may be mounted at the plating apparatus illustrated in FIG. 3. To explain in reference to FIG. 3, the object to be plated 6 may be a substrate for various types of electronic components or an IC wafer, and is patterned to enable pattern plating. If the object to be plated 6 is a wafer for various types of electronic components, the pattern plating method is adopted in order to form take-out electrodes.

Figure 7:
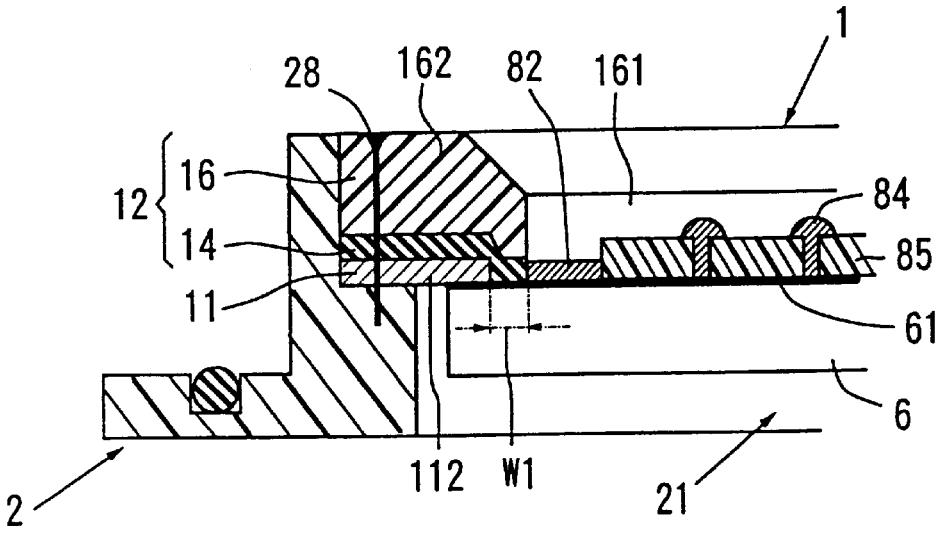
FIG. 7 illustrates deposition of a plating film achieved by employing the cathode device illustrated in FIGS. 5 and 6 and FIG. 8 is a graph illustrating the relationship between the number of continuously plated wafers and the plating film thickness.

When employing the cathode device illustrated in FIGS. 5 and 6, almost the entire plate forming surface 61 of the object to be plated is covered with a resist film 85, a pattern of perforations for plating is opened at the resist film 85 and a plate 84 is electro-deposited over the area where the pattern of perforations is present, as illustrated in FIG. 7.

In the cathode device, the internal circumferential edge of the cathode member 1 is covered with the internal circumferential edge of the frame portion 142 of the first insulating member 14 over the width W1. This structure allows no room for a plating film 82 to become adhered at the internal circumferential edge of the cathode member 11 even when the plating film 82 does become adhered to the area between the vicinity of the resist film 85 and the internal circumferential edge of the first insulating member 14. Thus, since the plating process can be implemented using the cathode member 11 maintaining a virtually consistent bore diameter even when different wafers are continuously plated using the same cathode device, the film formation rate of the plating film is stabilized among the individual wafers to achieve an improvement in repeating reproducibility among the wafers.

Figure 8:
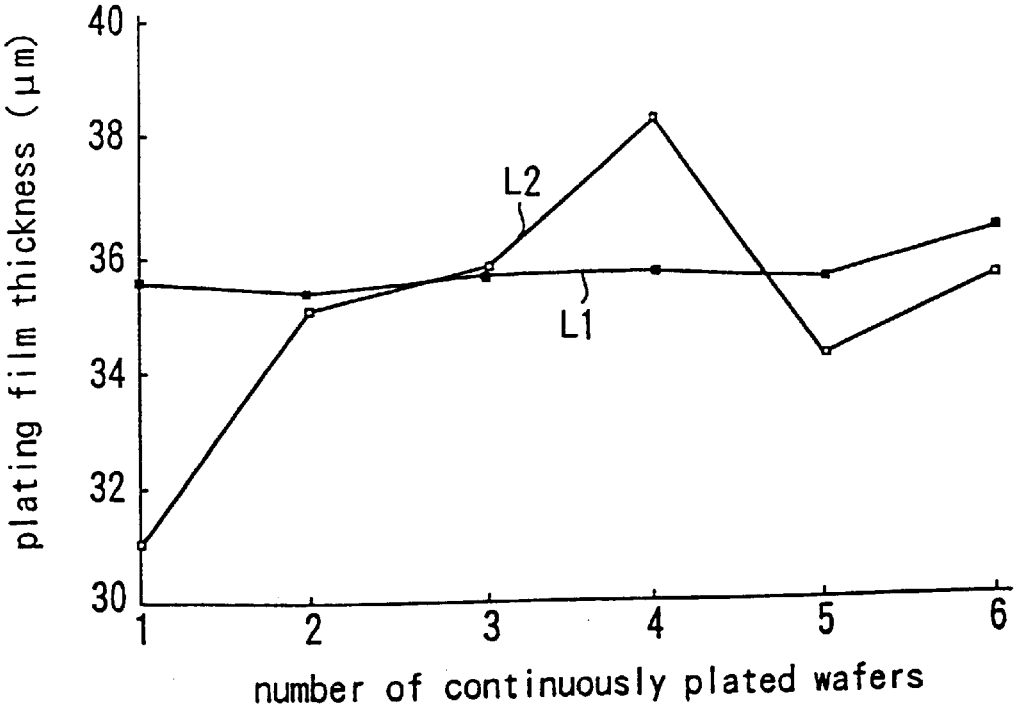

FIG. 8 presents a graph illustrating the relationship between the number of continuously plated wafers and the plating film thickness. The curve L1 represents the characteristics achieved by employing the cathode device according to the present invention and the curve L2 represents characteristics achieved in an example of the prior art in which the internal circumferential edge of the cathode member 11 is not covered. As comparison of the curve L1 and the curve L2 clearly shows, a marked improvement is achieved in the repeating reproducibility among wafers according to the present invention.

In the embodiment illustrated in FIGS. 5 and 6, the insulating member 12 includes the first insulating member 14 and the second insulating member 16. The first insulating member 14 is constituted of a resilient material whereas the second insulating member 16 is constituted of a material that is harder than that constituting the first insulating member 14 and is placed over the first insulating member 14. Through this structure, sufficient tight-contact force is assured through the resiliency of the first insulating member 14 and at the same time, incorrect positioning which may otherwise occur due to the resilient deformation of the first insulating member 14 can be prevented by the second insulating member 16.

In the mode described above, in which the insulating member 12 includes the first insulating member 14 and the second insulating member 16 the internal circumferential edge of the cathode member 11 is covered by the first insulating member 14 over the width W1. This structure allows the resiliency of the first insulating member 14 constituted of a resilient material to be directly applied to the cathode member 11 in a reliable manner so that overall tight contact is assured in spite of the presence of the hard second insulating member 16.

What is claimed is:

1. An electrode assembly comprising:

a cathode member provided with a hole enclosed by a frame portion and a contact surface that comes into contact with an object to be plated at one surface of said frame portion; and an insulating member provided with a hole enclosed by a frame portion, with one surface of said frame portion lying adjacent to another surface of said frame portion of said cathode member, said hole being concentric with said hole of said cathode member, and wherein an internal circumferential edge of said frame portion of the insulating member covers an internal circumferential edge of said cathode member.

2. The electrode assembly of claim 1 wherein said insulating member includes:

a first insulating member including of a resilient material and having a hole enclosed by a frame portion; and a second insulating member including of a material harder than said first insulating member and having a hole enclosed by a frame portion, which is provided adjacent to said first insulating member with said hole concentric with said hole of said first insulating member.

3. The electrode assembly of claim 2 wherein one surface of said frame portion of said first insulating member is adjacent to another surface of said frame portion of said cathode member; and one surface of said frame portion of said second insulating member is adjacent to another surface of said frame portion of said first insulating member.

4. The electrode assembly of claim 1 further comprising:

a second cathode member provided with a hole enclosed by a frame portion, with one surface of said frame portion lying adjacent to another surface of said insulating member and said hole concentric with said hole of said insulating member.

5. The electrode assembly of claim 1, wherein said insulating member covers an internal circumferential surface of said cathode member.

6. The electrode assembly of claim 5, wherein said insulating member covers said internal circumferential surface of said cathode member entirely.

7. A cathode device comprising an electrode assembly and a holder, said electrode assembly being supported by said holder and including:

a cathode member provided with a hole enclosed by a frame portion and a contact surface that comes into contact with an object to be plated at one surface of said frame portion; and an insulating member provided with a hole enclosed by a frame portion, with one surface of said frame portion lying adjacent to another surface of said frame portion of said cathode member, said hole being concentric with said hole of said cathode member, and wherein an internal circumferential edge of said frame portion of the insulating member covers an internal circumferential edge of said cathode member.

8. The cathode device of claim 7 wherein said insulating member includes:

a first insulating member including a resilient material and having a hole enclosed by a frame portion; and a second insulating member including a material harder than said first insulating member and having a hole enclosed by a frame portion, which is provided adjacent to said first insulating member with said hole concentric with said hole of said first insulating member.

9. The cathode device of claim 8, wherein one surface of said frame portion of said first insulating member is adjacent to another surface of said frame portion of said cathode member; and one surface of said frame portion of said second insulating member is adjacent to another surface of said frame portion of said first insulating member.

10. The cathode device of claim 7 further comprising:

a second cathode member provided with a hole enclosed by a frame portion, with one surface of said frame portion lying adjacent to another surface of said insulating member and said hole concentric with said hole of said insulating member.

11. The cathode device of claim 7, wherein said insulating member covers an internal circumferential surface of said cathode member.

12. The cathode device of claim 11, wherein said insulating member covers said internal circumferential surface of said cathode member entirely.

13. A plating apparatus comprising a plating tank for storing a plating bath solution and a cathode device;

said cathode device comprising an electrode assembly and a holder;

said electrode assembly being supported by said holder and including:

a cathode member provided with a hole enclosed by a frame portion and a contact surface that comes into contact with an object to be plated at one surface of said frame portion; and an insulating member provided with a hole enclosed by a frame portion, with one surface of said frame portion lying adjacent to another surface of said frame portion of said cathode member, said hole overlapping said hole of said cathode member, and wherein an internal circumferential edge of said frame portion of the insulating member covers an internal circumferential edge of said cathode member; and an anode device that, together with said cathode device, comprises an electrical circuit for plating via a plating bath solution within said plating tank.

14. The plating apparatus of claim 13 wherein said insulating member of said electrode assembly includes:

a first insulating member including a resilient material and having a hole enclosed by a frame portion; and a second insulating member including a material harder than said first insulating member and having a hole enclosed by a frame portion, which is provided adjacent to said first insulating member with said hole concentric with said hole of said first insulating member.

15. The plating apparatus of claim 14 wherein one surface of said frame portion of said first insulating member of said electrode assembly is adjacent to another surface of said frame portion of said cathode member; and one surface of said frame portion of said second insulating member is adjacent to another surface of said frame portion of said first insulating member.

16. The plating apparatus of claim 13 wherein said electrode assembly further comprises a second cathode member provided with a hole enclosed by a frame portion, with one surface of said frame portion lying adjacent to another surface of said insulating member and said hole concentric with said hole of said insulating member.

17. The plating apparatus of claim 13 wherein said cathode device is mounted at said plating tank so that said object to be plated can be placed in contact with said contact surface of said cathode member constituting said electrode assembly from the outside of said plating tank.

18. The plating apparatus of claim 13, wherein said insulating member covers an internal circumferential surface of said cathode member.

19. The plating apparatus of claim 18, wherein said insulating member covers said internal circumferential surface of said cathode member entirely.

* * * * *